US008888091B2

(12) United States Patent
Hosohara

(10) Patent No.: US 8,888,091 B2
(45) Date of Patent: Nov. 18, 2014

(54) SHEET FEEDING APPARATUS AND IMAGE FORMING APPARATUS

(71) Applicant: Canon Kabushiki Kaisha, Tokyo (JP)

(72) Inventor: Kazuhiro Hosohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/797,197

(22) Filed: Mar. 12, 2013

(65) Prior Publication Data

US 2013/0241136 A1 Sep. 19, 2013

(30) Foreign Application Priority Data

Mar. 15, 2012 (JP) ..... 2012-058905

(51) Int. Cl.
*B65H 3/06* (2006.01)

(52) U.S. Cl.
CPC ..... *B65H 3/06* (2013.01); *B65H 2403/512* (2013.01); *B65H 2403/721* (2013.01); *B65H 3/0607* (2013.01); *B65H 3/0669* (2013.01); *B65H 2403/511* (2013.01)
USPC ..... 271/118; 271/127; 271/160

(58) Field of Classification Search
CPC ..... B65H 3/0684; B65H 3/0669; B65H 1/14
USPC ..... 271/117, 118, 126, 127, 145, 147, 160
See application file for complete search history.

(56) References Cited

U.S. PATENT DOCUMENTS 4,717,139 A * 1/1988 Sootome et al. ..... 271/116
4,900,003 A * 2/1990 Hashimoto ..... 271/114

FOREIGN PATENT DOCUMENTS

JP 4312697 B2 8/2009

* cited by examiner

*Primary Examiner* — Michael McCullough
(74) *Attorney, Agent, or Firm* — Canon U.S.A., Inc. IP Division

(57) ABSTRACT

A sheet feeding apparatus includes a stacking plate configured to stack sheets, a sheet feeding unit configured to feed the sheets by contacting the sheets stacked on the stacking plate, an elevating unit configured to elevate the stacking plate by a drive transmitted from a drive unit, a drive transmission unit configured to transmit the drive from the drive unit to drive the sheet feeding unit, and a clutch mechanism configured to cause the drive transmission unit to transmit the drive from the drive unit to the sheet feeding unit after the elevating unit urges the sheets stacked on the stacking plate toward the sheet feeding unit by elevating the stacking plate.

19 Claims, 8 Drawing Sheets

SHEET FEEDING APPARATUS AND IMAGE FORMING APPARATUS

BACKGROUND OF THE INVENTION

1. Field of the Invention

Aspects of the present invention generally relate to a sheet feeding apparatus and an image forming apparatus equipped with the sheet feeding apparatus.

2. Description of the Related Art

Conventionally, an image forming apparatus for forming an image on a sheet is provided with a sheet feeding apparatus configured to elevate a stacking plate with sheets stacked thereon to bring the uppermost sheet into contact with a feeding roller to feed the sheet. In a sheet feeding apparatus as described above, each time a feeding operation is performed, the stacking plate is elevated by a cam configured to rotate with the feeding roller to move the sheets stacked on the stacking plate between positions where the feeding roller is urged to and separated from the sheets.

In such a construction, there is a difference in the timing with which the sheet contacts the feeding roller between the case when a full number of sheets are stacked on the stacking plate and the case when a small number of sheets are stacked thereon (hereinafter, referred to as the "small-number stacking"), resulting in variation in the interval between the sheets being fed. This is because, depending on the number of sheets stacked, there is a difference in the distance between the uppermost one of the sheets stacked on the stacking plate and the feeding roller when the cam lowers the stacking plate. Then, the smaller the number of sheets stacked on the stacking plate, the larger the distance between the uppermost sheet and the feeding roller, and the later the timing at which the sheet contacts the feeding roller, resulting in an increase in the interval between the sheets being fed.

In this connection, Japanese Patent No. 4312697 discusses a sheet feeding apparatus having a feeding roller provided with a low friction coefficient portion causing no feeding even if a sheet contacts the same to reduce variation between the sheets being fed.

However, in the sheet feeding apparatus discussed in Japanese Patent No. 4312697, it is necessary to provide both a low friction coefficient portion causing no sheet feeding to the feeding roller and a high friction coefficient portion causing sheet feeding thereto, so that the outer diameter of the feeding roller is required to be large. Then, when the outer diameter of the feeding roller increases, the size of the sheet feeding apparatus also increases.

SUMMARY OF THE INVENTION

Aspects of the present invention related to a sheet feeding apparatus involving no increase in size and no variation between the sheets fed.

According to an aspect of the present invention, a sheet feeding apparatus includes a stacking plate configured to stack sheets, a sheet feeding unit configured to feed the sheets by contacting the sheets stacked on the stacking plate, an elevating unit configured to elevate the stacking plate by a drive transmitted from a drive unit, a drive transmission unit configured to transmit the drive from the drive unit to drive the sheet feeding unit, and a clutch mechanism configured to cause the drive transmission unit to transmit the drive from the drive unit to the sheet feeding unit after the elevating unit urges the sheets stacked on the stacking plate toward the sheet feeding unit by elevating the stacking plate.

According to an exemplary embodiment of the present invention, the sheet feeding unit is driven after the sheets stacked on the stacking plate is urged toward the sheet feeding unit. Accordingly, it is possible to provide a sheet feeding apparatus without increase in size and variation between the sheets being fed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
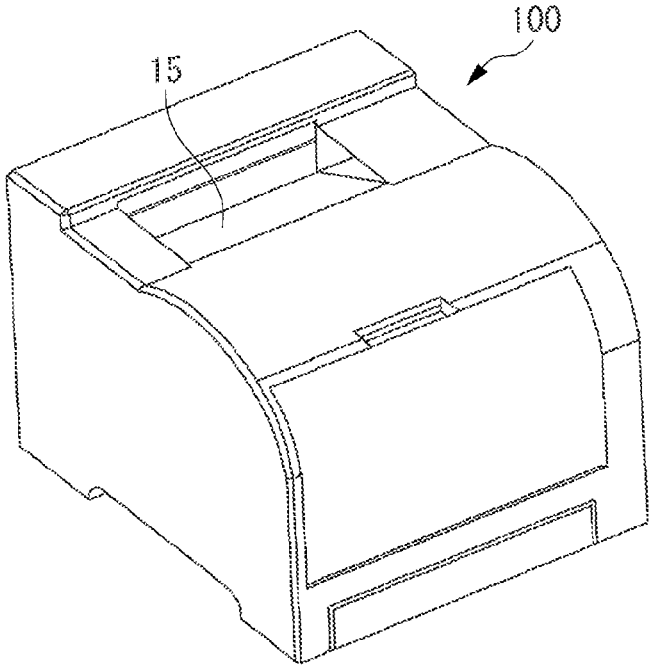
FIGS. 1A and 1B are diagrams illustrating an overall construction of an image forming apparatus according to an exemplary embodiment.
Figure 1B:
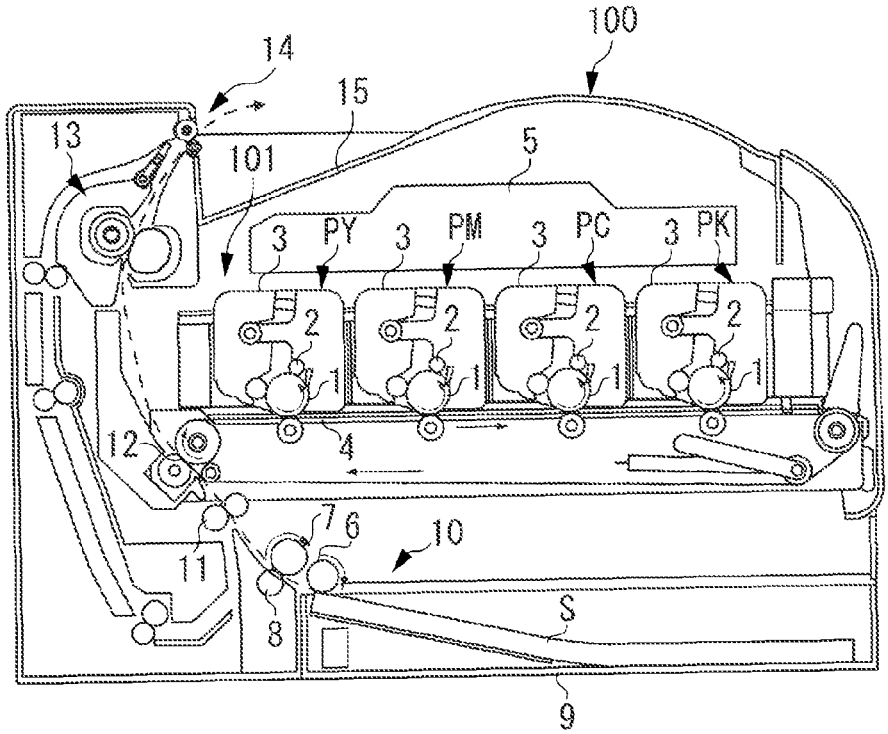

FIGS. 1A and 1B illustrate a color digital printer as an example of an image forming apparatus to which a sheet feeding apparatus according to the present invention is applicable. FIG. 1A is an external perspective view illustrating an image forming apparatus 100, and FIG. 1B is a schematic sectional view illustrating the image forming apparatus 100. The image forming apparatus is a four full-color laser printer employing the electrophotographic process. That is, the laser printer forms an image on a sheet (a recording medium) S based on an image signal input to a controller unit (a control unit) from an external host apparatus such as a personal computer, an image reader, or a facsimile apparatus at the other end of the line.

In the following, the operation of forming an image by an image forming unit 101 will be described. Drums 1 of first to fourth cartridges PY, PM, PC, and PK are driven to be rotated counterclockwise as indicated by the arrows at a predetermined control speed. A belt 4 is also driven to be rotated clockwise as indicated by the arrow (the forward direction with respect to the rotation of the drums 1) at a speed corresponding to the speed of the drums 1. A scanner unit 5 is also driven.

In synchronization with this driving, in the cartridges, charging rollers 2 uniformly charge the surfaces of the drums 1 at a predetermined polarity and potential with a predetermined control timing. The scanner unit 5 performs scanning exposure on the surfaces of the drums 1 with a laser beam modulated in correspondence with image signals of the different colors.

As a result, the regions of the surfaces of the drums 1 which have undergone scanning exposure with the laser beam constitute electrostatic latent images corresponding to the image signals. The electrostatic latent images formed on the surfaces of the drums 1 are developed into toner images by developing units 3. With the above-described electrophotographic image forming operation, toner images are formed on the drums 1, and the formed toner images are primarily transferred onto the belt 4.

A feeding cassette 9 is attachable and detachable to and from the image forming apparatus 100 from the apparatus front side (the side on which the operator performs operation, i.e., the right-hand side of the image forming apparatus 1 as illustrated in FIG. 1B), thus enabling the user to easily perform the operations of positioning sheets and jam processing.

A pickup roller 6 contacts the sheets stacked on a stacking plate 16 of the feeding cassette 9, serving as a sheet feeding unit for feeding the sheets. The sheets fed by the pickup roller 6 are separately fed by a feed roller 7 and a separation roller 8, and each of the separated sheets is conveyed to a secondary transfer nip portion of a secondary transfer roller 12 and the belt 4 byway of a registration roller pair 11. The separation roller 8 is mounted on the apparatus main body via a torque limiter (not illustrated), and is held in press contact with the feed roller 7 by an urging unit, such as a spring (not illustrated).

The sheet onto which the toner images have been transferred at the secondary transfer nip portion undergoes heating and pressurization at a fixing unit 13, whereby the toner images are fixed to the sheet. Then, the sheet onto which the toner images have been fixed is discharged onto a discharge tray 15 by a discharge roller pair 14.

Figure 2:
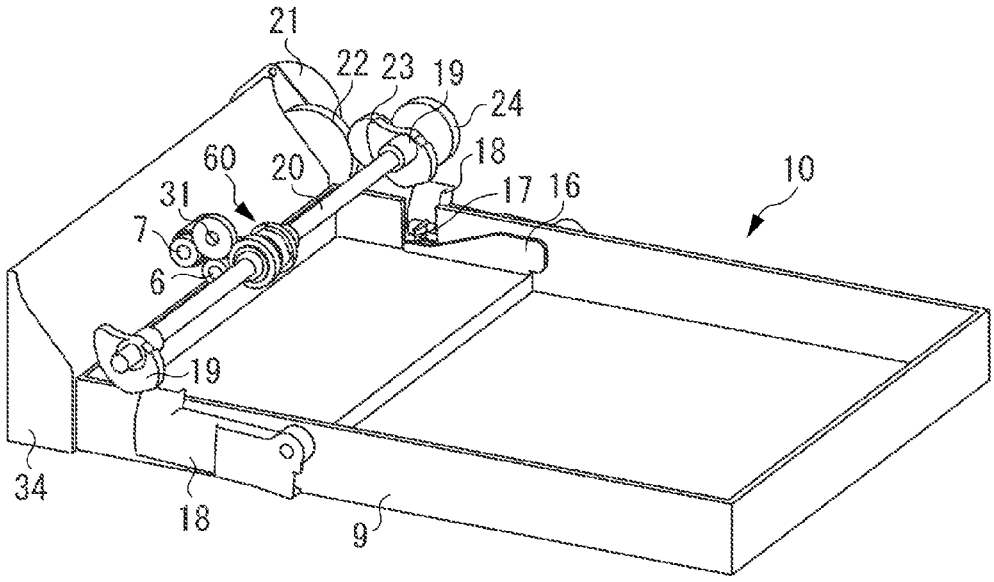
FIG. 2 is a diagram illustrating a sheet feeding apparatus according to an exemplary embodiment.

Next, a sheet feeding apparatus will be described. FIG. 2 is a schematic perspective view illustrating a sheet feeding apparatus 10. A stacking plate 16, on which the sheets are stacked, is capable of elevating.

Figure 3:
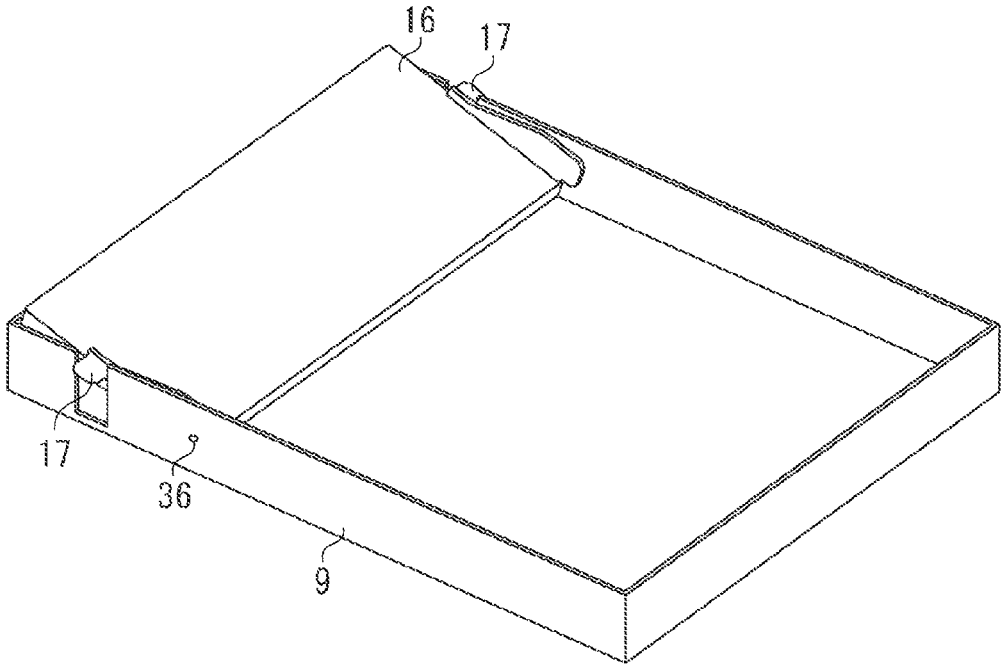
FIG. 3 is a schematic perspective view illustrating a feeding cassette.
Figure 4A:
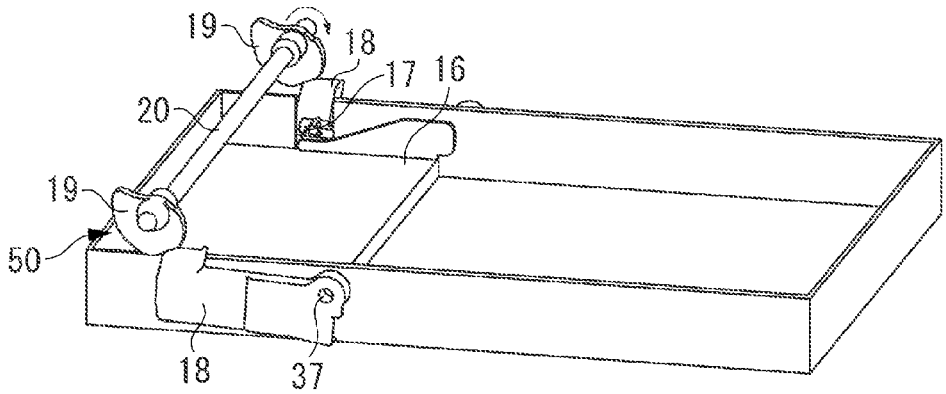
FIGS. 4A and 4B are diagrams illustrating an elevating unit for elevating a stacking plate.
Figure 4B:
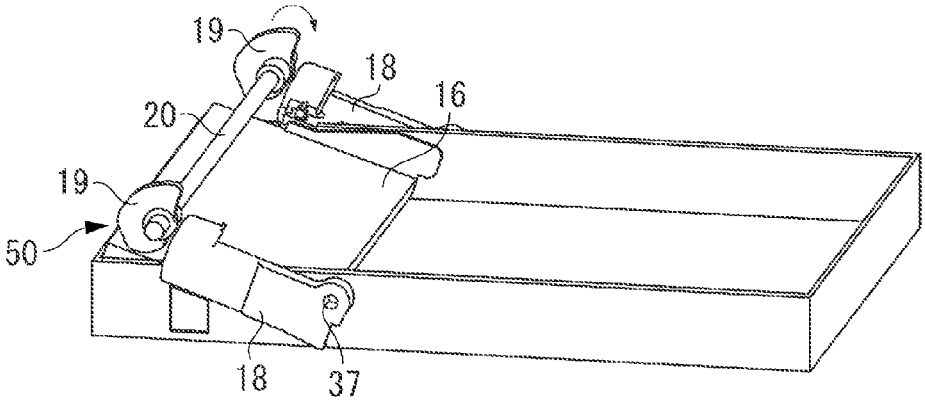

The operation of elevating the stacking plate 16 will be described with reference to FIGS. 3, 4A, and 4B. FIG. 3 is a schematic perspective view illustrating the feeding cassette 9, FIG. 4A is a schematic perspective view illustrating a lowered state of the stacking plate 16 according to the present exemplary embodiment, and FIG. 4B is a schematic perspective view illustrating an elevated state of the stacking plate 16 according to the present exemplary embodiment.

As illustrated in FIG. 3, the stacking plate 16 is positioned rotatably around a stacking plate rotation supporting portion 36. The stacking plate 16 is elevated by an elevating unit 50. The elevating unit 50 elevates the stacking plate 16 to urge the sheets stacked thereon toward the pickup roller 6, and lowers the stacking plate 16 to separate the sheets stacked thereon from the pickup roller 6.

Even when the number of sheets stacked on the stacking plate 16 is small, the elevating unit 50 elevates the stacking plate 16 until the sheets are sufficiently urged toward the pickup roller 6.

The elevating unit 50 has elevating levers 18, elevating lever rotation supporting portions 37, a pair of elevating cams 19, and a connection shaft 20 connecting the pair of elevating cams 19 to each other.

The respective elevating levers 18 are provided on both sides of the feeding cassette 9, and are fixed to the casing of the image forming apparatus 100 to be rotatable around the elevating lever rotation supporting portions 37. The elevating levers 18 are urged toward the pickup roller 6 (upwards) by an urging member, such as a spring (not illustrated). On both sides of the stacking plate 16, there are provided engagement portions 17 by which the stacking plate 16 engages with the elevating levers 18. In the state in which the feeding cassette 9 is attached to the image forming apparatus 100 and set in position, the engagement portions 17 and the elevating levers 18 are engaged with each other and the stacking plate 16 elevates in conjunction with the rotation of the elevating levers 18. The rotation of the elevating levers 18 urged toward the pickup roller 6 is restricted by the elevating cams 19 arranged above the elevating levers 18. As illustrated in FIGS. 4A and 4B, the connection shaft 20 rotates by receiving drive from a drive unit described below, whereby the elevating cams 19 rotate to vertically rotate the elevating levers 18, which elevates the stacking plate 16 via the engagement portions 17.

Figure 5:
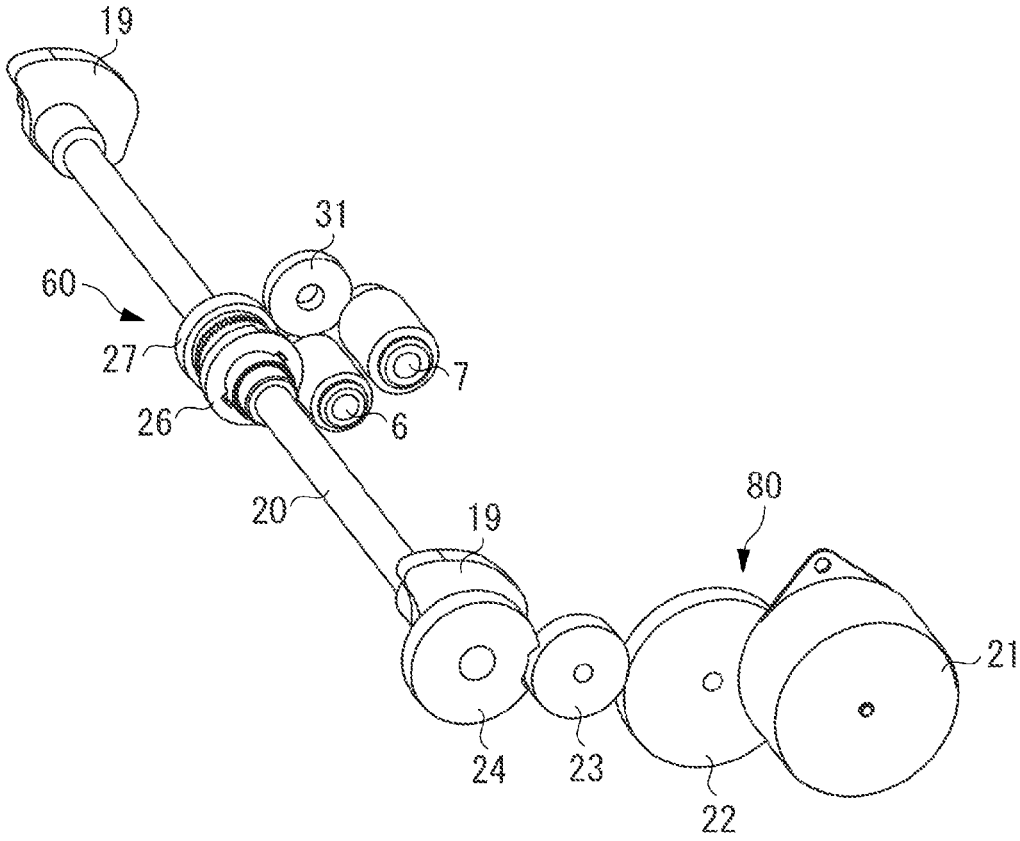
FIG. 5 is a diagram illustrating a drive transmission route from a drive source.

Next, a drive unit 80 will be described with reference to FIG. 5. The drive unit 80 transmits drive to the elevating unit 50 to elevate the stacking plate 16. The drive unit 80 rotates the pickup roller 6 via a drive transmission unit.

The apparatus main body is provided with a drive source 21, such as a motor, for the drive unit 80. The drive of the drive source 21 is transmitted from a first drive gear 22 to a second drive gear 23, and then, from the second drive gear 23 to a partially-toothless gear 24. Here, the partially-toothless gear 24 is restricted and restriction-released by a solenoid (not illustrated), and selectively meshes with the second drive gear 23. When the solenoid releases the restriction, the partially-toothless gear 24 meshes with the second drive gear 23, whereby the drive is transmitted to start rotation. Then, the partially-toothless gear 24 makes one rotation to bring the toothless portion of the partially-toothless gear 24 to a position opposite the second drive gear 23, and the solenoid restricts the partially-toothless gear 24 at this position, whereby the apparatus is placed in a drive non-transmission state.

The partially-toothless gear 24 and the elevating cams 19 are fixed to the connection shaft 20 rotatably supported by the apparatus main body, and rotate integrally with the connection shaft 20. Based on an electric signal from a control unit (not illustrated), the solenoid operates to release the restriction of the partially-toothless gear 24. Then, the partially-toothless gear 24 meshes with the second drive gear 23, and the drive of the drive source 21 is transmitted to the connection shaft 20 via the partially-toothless gear 24, with the connection shaft 20 making one rotation together with the elevating cams 19.

An idler gear 31 serves as a drive transmission unit for transmitting drive to the pickup roller 6 and the feed roller 7 via a clutch mechanism 60. The pickup roller 6 and the feed roller 7 have tooth surfaces configured to mesh with the idler gear 31, and each roller is driven to rotate by receiving the rotation of the idler gear 31.

A clutch input gear 26 serves as a clutch input portion, and a clutch output gear 27 serves as a clutch output portion. The drive of the drive unit 80 is input to the clutch input gear 26 to rotate the same, and the clutch output gear 27 connects with the clutch input gear 26, whereby the drive from the drive unit 80 is transmitted to the pickup roller 6. The idler gear 31 of the clutch output portion is arranged to mesh with the clutch output gear 27, so that, in the state in which the clutch input gear 26 is connected with the clutch output gear 27, the rotation of the connection shaft 20 is transmitted to the idler gear 31, and the pickup roller 6 and the feed roller 7 are driven. In the state in which the clutch input gear 26 is not connected with the clutch output gear 27, the rotation of the connection shaft 20 is not transmitted to the idler gear 31.

When the connection shaft 20 makes one rotation, the pickup roller 6 and the feed roller 7 rotate. The conveyance distance at which the sheet is conveyed by this rotation is set to allow conveyance of the sheet to the registration roller pair 11 on the downstream side.

Next, the clutch mechanism 60 will be described in detail. The clutch input gear 26 of the clutch mechanism 60 connects with the clutch output gear 27 after the elevating unit 50 elevates the stacking plate 16 and brings the stacked sheets into press-contact with the pickup roller 6. As a result, after the sheets stacked on the stacking plate 16 is brought into press-contact with the pickup roller 6, the rotation of the pickup roller 6 starts, so that there is no variation in the intervals between the sheets being fed. Thus, even when the number of sheets stacked on the stacking plate 16 is changed and deviation is generated in the timing with which the sheets and the pickup roller 6 contact each other, the timing with which the pickup roller 6 feeds out the sheets is constant regardless of the amount of stacked sheets.

Figure 6:
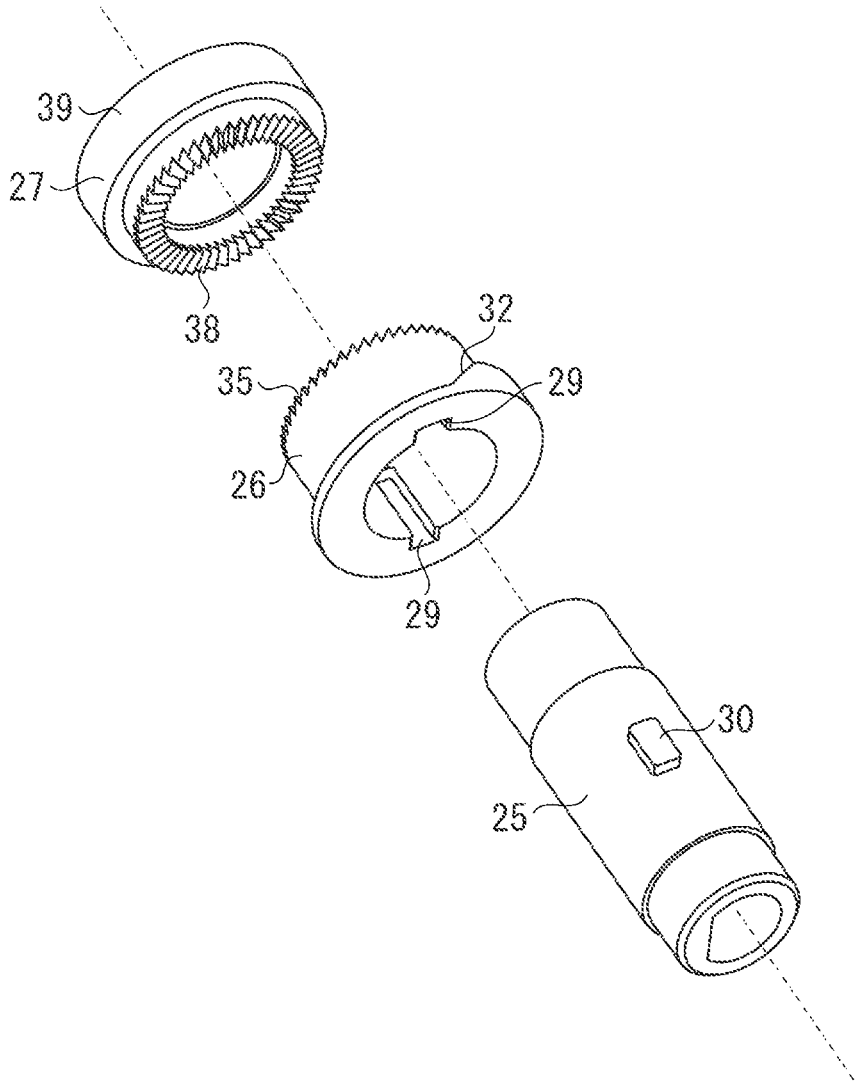
FIG. 6 is a schematic perspective view illustrating a clutch mechanism.
Figure 7A:
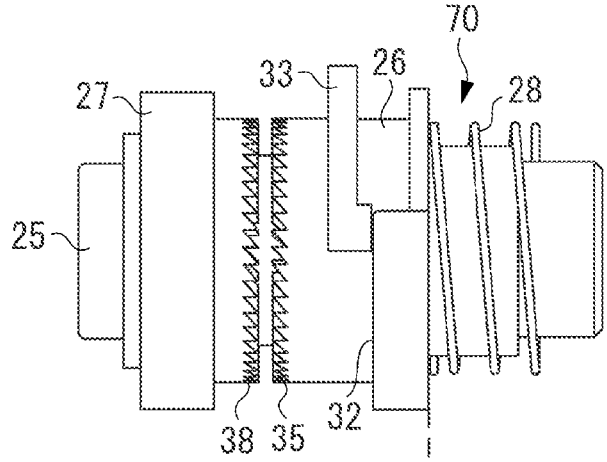
FIGS. 7A, 7B, and 7C are diagrams illustrating operations of engaging/disengaging the clutch mechanism.
Figure 7B:
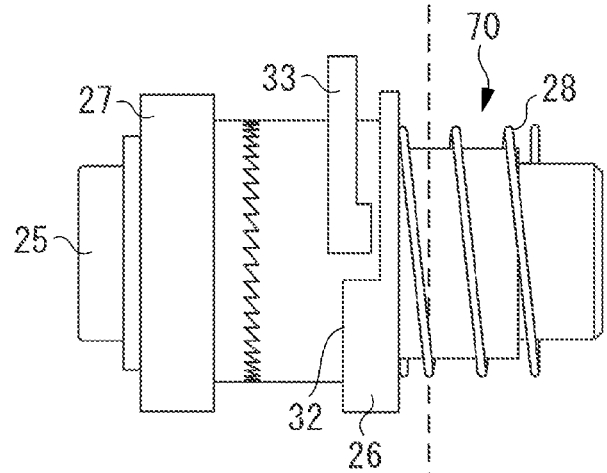
Figure 7C:
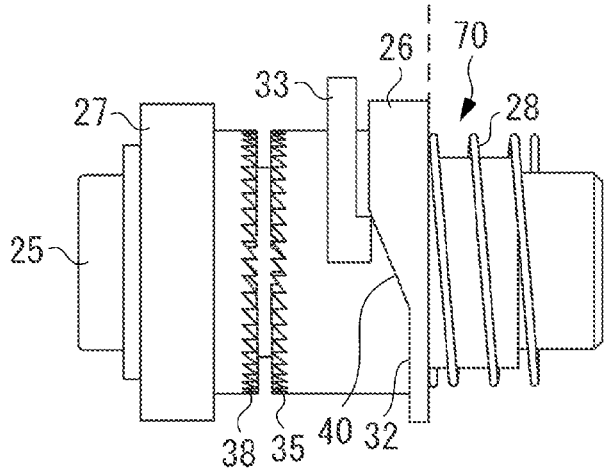

FIG. 6 is a schematic perspective view illustrating the clutch mechanism 600 according to the present exemplary embodiment, FIG. 7A is a schematic diagram illustrating the clutch mechanism 60 as disengaged, FIG. 7B is a schematic diagram illustrating the clutch mechanism as engaged, and FIG. 7C is a schematic diagram illustrating how the clutch mechanism 60 is switched from the engaged state to the disengaged state.

As illustrated in FIG. 6, a clutch bearing 25 is fixed to the connection shaft 20 and integrally rotates with the connection shaft 20. Further, a key 30 is formed on the clutch bearing 25. The clutch input gear 26 has a key groove 29, a cam surface 32, and an input side gear toothed surface 35. The clutch input gear 26 is retained in the clutch bearing 25 by the key 30 of the clutch bearing 25 engaging with the key groove 29. The clutch input gear 26 is stationary in the rotational direction of the clutch bearing 25, and is movable in the longitudinal direction (the rotation axis direction) of the connection shaft 20. The clutch output gear 27 includes a tooth surface 39 to mesh with the idler gear 31 and an output side gear toothed surface 38, and is rotatably retained by the clutch bearing 25. The portion of the clutch output gear 27 extending in the longitudinal direction of the connection shaft 20 is fixed to the main body of the image forming apparatus 100. As illustrated in FIG. 7A, the clutch input gear 26 is urged by a clutch pressing spring 28 serving as an elastic member urging the clutch input gear 26 toward the clutch output gear 27.

Next, the operation of engaging and disengaging the clutch mechanism 60 will be described with reference to FIGS. 7A, 7B, and 7C.

As illustrated in FIG. 7A, in the state in which the cam surface 32 provided on the clutch input gear 26 is locked to a clutch restriction rib 33 provided on the apparatus main body, the input side gear toothed surface 35 of the clutch input gear 26 separates from the output side gear toothed surface 38 of the clutch output gear 27. In this way, in the state in which the clutch mechanism 60 is disengaged, no drive is transmitted.

As illustrated in FIG. 7B, when the input side gear toothed surface 35 of the clutch input gear 26 connects the output side gear toothed surface 38 of the clutch output gear 27, the clutch mechanism 60 is engaged. In this way, in the state in which the clutch mechanism 60 is engaged, drive is transmitted to the pickup roller 6 and the feed roller 7 from the connection shaft 20 via the idler gear 31. In this way, switching between the engagement and disengagement of the clutch mechanism 60 is effected by the cam surface 32 rotating integrally with the connection shaft 20 and by the clutch restriction rib 33.

When, in the disengaged state of the clutch mechanism 60 illustrated in FIG. 7A, the connection shaft 20 rotates, the clutch bearing 25 fixed to the connection shaft 20 rotates, and the clutch input gear 26 is also rotated via the key groove 29 and the key 30. The clutch restriction rib 33 is fixed to the apparatus main body, so that, when the clutch input gear 26 rotates, the relative position between the clutch restriction rib 33 and the cam surface 32 is deviated.

When the clutch input gear 26 rotates by a predetermined amount, the cam surface 32 is released from the restriction by the clutch restriction rib 33. Then, due to the urging force of the clutch pressing spring 28, the input side gear toothed surface 35 of the input gear 26 contacts the output side gear toothed surface 38 of the clutch output gear 27, and the clutch mechanism 60 is placed in the engaged state as illustrated in FIG. 7B.

The cam surface 32 has a slope surface 40. When the clutch input gear 26 further rotates, as illustrated in FIG. 7C, the slope surface 40 climbs up the clutch restriction rib 33. Then, the cam surface 32 and the clutch restriction rib 33 are placed in the locked state again, and the input side gear toothed surface 35 and the output side gear toothed surface 38 are separated from each other.

When, in the state illustrated in FIG. 7C, the connection shaft 20 further rotates, the clutch is placed in the disengaged state illustrated in FIG. 7A. As described above, due to a movement mechanism 70 configured to move the clutch input gear 26 having the clutch pressing spring 28, the cam surface 32, and the clutch restriction rib 33, the clutch input gear 26 moves between the engagement position where the clutch input gear 26 is engaged with the clutch output gear 27 and the disengagement position where the clutch input gear 26 is disengaged from the same. That is, the movement mechanism 70 moves the clutch input gear 26 in a position along the axial direction of the connection shaft 20 corresponding to the rotational angle of the clutch input gear 26 by the cam surface 32 and the clutch restriction rib 33.

The elevating cams 19 provided on the connection shaft 20 and the clutch input gear 26 rotate in synchronization with each other. Then, the cam surface 32 of the movement mechanism 70 is formed such that, after the elevating cams 19 elevates the stacking plate 16 and the sheets stacked thereon are urged toward the pickup roller 6, the clutch input gear 26 is moved to the engagement position by the movement mechanism 70.

Next, the feeding operation timing of the sheet feeding apparatus will be described.

Figure 8:
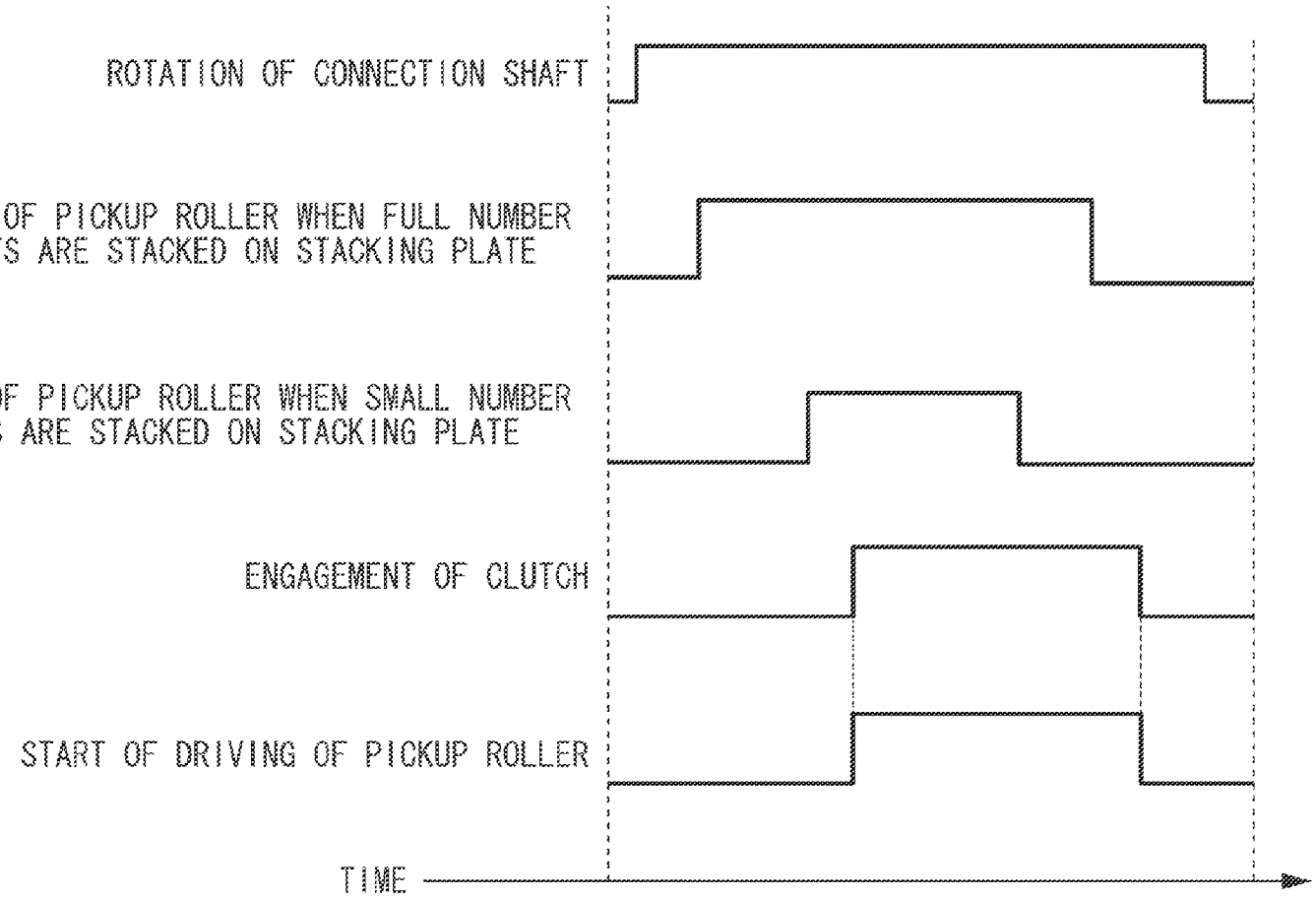
FIG. 8 is a timing chart illustrating a feeding operation.

FIG. 8 is a timing chart illustrating the feeding operation according to the present exemplary embodiment. The respective rises of the line indicate the start of operation, and the respective falls of the line indicate the completion of the operation.

When a sheet feeding signal is input to the control unit in response to an instruction from the user, the control unit starts driving of the drive source 21. Then, at a predetermined timing, based on the count value of a timer, the solenoid (not illustrated) mentioned above is attracted based on an electric signal from the control unit, and the partially-toothless gear 24 and the second drive gear 23 mesh with each other. As a result, the drive of the drive source 21 is transmitted to the connection shaft 20 via the partially-toothless gear 24, and the connection shaft 20 starts to rotate together with the elevating cams 19 and the clutch bearing 25.

As a result of the rotation of the elevating cams 19, the elevating levers 18 rotate, and the stacking plate 16 also starts to be elevated via the engagement portions 17 with the elevating levers 18. Here, as illustrated in FIG. 8, depending upon the amount of sheets S stacked on the stacking plate 16, deviation is generated in the timing with which the sheets S and the pickup roller 6 are brought into press contact with each other.

In the present exemplary embodiment, due to the cam surface 32 and the clutch restriction rib 33, even when the number of sheets stacked on the stacking plate 16 is small, the clutch mechanism 60 engages after the sheets S and the pickup roller 6 contact with each other. Thus, even when the sheets S and the pickup roller 6 contact with each other, the feeding of the sheets is not started at once. As illustrated in FIG. 8, the feeding of the sheets starts only when the clutch mechanism 60 engages. That is, the clutch 60 engages at a fixed position in one rotation of the connection shaft 20, so that the timing with which the sheets are fed is fixed.

Thus, even when deviation is generated in the timing with which the sheets S and the pickup roller 6 contact with each other, the timing with which the pickup roller 6 transmits sheets is fixed regardless of the number of sheets stacked, so that there is no variation in the interval between the sheets being fed. After one rotation of the connection shaft 20 is completed, the engagement of the clutch mechanism 60 is released by the cam surface 32 and the clutch restriction rib 33, and the clutch mechanism 60 is placed in the disengaged state as illustrated in FIG. 7A.

In the state in which the engagement of the clutch mechanism 60 is released, the pickup roller 6 and the feed roller 7 are driven-rotatable. Therefore, no back tension is applied to the sheets, and no conveyance resistance is offered to the registration roller pair 11 on the downstream side. Further, the distance of which the sheet is conveyed by the pickup roller 6 and the feed roller 7 may be set freely according to the speed reduction ratio of the gears 27 and 31 with respect to one rotation of the connection shaft 20 or the speed reduction ratio of the diameter of each roller. Thus, even when the configuration according to the present exemplary embodiment is employed to eliminate variation in the interval between the sheets being fed, there is no need to increase the outer diameter of the pickup roller 6 and of the feed roller 7. According to the above-described embodiment, it is possible to mitigate, at low cost, variation in the interval between the sheets being fed to be generated depending upon the number of stacked sheets without involving an increase in apparatus size.

While, in the above-described exemplary embodiment, the mesh engagement between the partially-toothless gear 24 and the second drive gear 23 is controlled by a solenoid, the engagement may be controlled by using an electromagnetic clutch.

Further, in the above-described exemplary embodiment, the clutch input gear 26 and the clutch output gear 27 connected together are of a toothed surface configuration. However, the clutch input gear 26 and the clutch output gear 27 may contact with each other via frictional members with large sliding resistance since it is only necessary to allow transmission of the drive.

Further, in the above-described exemplary embodiment, there are provided one cam surface 32 and one clutch restriction rib 33. However, a plurality of cam surface 32 and restriction rib 33 may be provided to effect the engagement and disengagement of the clutch a plurality of times as the clutch input gear 26 rotates.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-058905 filed Mar. 15, 2012, which is hereby incorporated by reference herein in its entirety.

What is claimed is:

1. A sheet feeding apparatus comprising:

a stacking member on which a sheet is stacked;

a sheet feeding unit configured to feed the sheets by contacting the sheets stacked on the stacking member;

a shaft configured to be rotatable, the sheet feeding unit being configured to feed the sheet according to a rotation of the shaft;

an elevating unit configured to elevate the stacking member according to the rotation of the shaft;

a drive unit configured to generate a driving power and to rotate the shaft; and a clutch mechanism configured to transmit the driving power from the drive unit to the sheet feeding unit after the elevating unit elevates the stacking member so that the sheet stacked on the stacking member contacts the sheet feeding unit, the clutch mechanism comprising:

a clutch input portion configured to rotate according to the rotation of the shaft;

a clutch output portion configured to transmit the driving power from the drive unit to the sheet feeding unit by engaging with the clutch input portion; and a movement mechanism configured to move the clutch input portion between a disengagement position where the clutch input portion disengages from the clutch output portion and an engagement position where the clutch input portion engages with the clutch output portion, wherein the movement mechanism is configured to move the clutch input portion between the disengagement position and the engagement position according to the rotation of the shaft.

2. The sheet feeding apparatus according to claim 1, wherein the elevating unit includes:

an elevating cam provided on the shaft and configured to elevate the stacking member, wherein, during one rotation of the shaft, the clutch input portion moves between the disengagement position and the engagement position in synchronization with the rotation of the shaft.

3. The sheet feeding apparatus according to claim 1, wherein the movement mechanism includes:

a cam provided on the clutch input portion;

an elastic member configured to urge the clutch input portion toward the clutch output portion; and a clutch restriction member configured to lock the clutch input portion at the disengagement position by contacting the cam urged by the elastic member, and wherein, when the drive unit is driven to rotate the clutch input portion, the lock between the cam and the clutch restriction member is released, so that the clutch input portion moves from the disengagement position to the engagement position, and wherein, when the clutch input portion further rotates, the cam and the clutch restriction member are locked again, so that the clutch input portion moves to the disengagement position.

4. The sheet feeding apparatus according to claim 3, wherein the cam has a slope surface, the clutch input portion is moved from the engagement position to the disengagement position by the slope surface contacting the clutch restriction member.

5. The sheet feeding apparatus according to claim 1, wherein the elevating unit is configured to raise the stacking member to urge the sheet stacked on the stacking member toward the sheet feeding unit, and lowers the stacking member to separate the sheet from the sheet feeding unit.

6. An image forming apparatus comprising:

the sheet feeding apparatus according to claim 1; and an image forming unit configured to form an image on a sheet fed by the sheet feeding apparatus.

7. The sheet feeding apparatus according to claim 1, wherein the clutch input portion is configured to move in an axial direction of the shaft.

8. The sheet feeding apparatus according to claim 7, wherein the clutch mechanism further comprises:

a clutch bearing fixed to the shaft and configured to integrally rotate with the shaft;

a key formed on the clutch bearing; and a key groove formed on the clutch input portion, with which the key engages so that the clutch input portion is configured to move in the axial direction of the shaft.

9. The sheet feeding apparatus according to claim 1, wherein the sheet feeding unit includes a roller configured to feed the sheet stacked on the stacking member, and wherein the clutch mechanism is provided on a transmitting path between the elevating unit and the sheet feeding roller.

10. The sheet feeding apparatus according to claim 9, wherein in a state the clutch input portion is at the disengagement position, the driving power of the drive unit is not transmitted to the sheet feeding roller, and wherein in a state the clutch input portion is at the engagement position, the driving power of the drive unit is transmitted to the sheet feeding roller.

11. The sheet feeding apparatus according to claim 1, wherein even when a number of sheets stacked on the stacking member is a few, the movement mechanism is configured to move the clutch input portion from the disengagement position to the engagement position after the elevating unit elevates the stacking member so that the sheet stacked on the stacking member contacts the sheet feeding unit.

12. A sheet feeding apparatus comprising:

a stacking member on which a sheet is stacked;

a sheet feeding unit configured to feed the sheet by contacting the sheet stacked on the stacking member;

a shaft configured to be rotatable, the sheet feeding unit being configured to feed the sheet according to a rotation of the shaft;

an elevating unit configured to elevate the stacking member according to the rotation of the shaft;

a drive unit configured to generate a driving power and to rotate the shaft; and a clutch mechanism configured to cause the drive transmission unit to transmit the driving power from the drive unit to the sheet feeding unit, the clutch mechanism comprising:

a clutch input portion configured to rotate according to the rotation of the shaft;

a clutch output portion configured to transmit the driving power from the drive unit to the sheet feeding unit by engaging with the clutch input portion; and a movement mechanism configured to move the clutch input portion between a disengagement position where the clutch input portion disengages from the clutch output portion and an engagement position where the clutch input portion engages with the clutch output portion, wherein the movement mechanism is configured to move the clutch input portion between the disengagement position and the engagement position according to the rotation of the shaft.

13. The sheet feeding apparatus according to claim 12, wherein the elevating unit includes:

an elevating cam provided on the shaft and configured to elevate the stacking member, wherein, during one rotation of the shaft, the clutch input portion moves between the disengagement position and the engagement position in synchronization with the rotation of the shaft.

14. The sheet feeding apparatus according to claim 12, wherein the movement mechanism includes:

a cam provided on the clutch input portion;

an elastic member configured to urge the clutch input portion toward the clutch output portion; and a clutch restriction member configured to lock the clutch input portion at the disengagement position by contacting the cam urged by the elastic member, and wherein, when the drive unit is driven to rotate the clutch input portion, the lock between the cam and the clutch restriction member is released, so that the clutch input portion moves from the disengagement position to the engagement position, and wherein, when the clutch input portion further rotates, the cam and the clutch restriction member are locked again, so that the clutch input portion moves to the disengagement position.

15. The sheet feeding apparatus according to claim 14, wherein the cam has a slope surface, the clutch input portion is moved from the engagement position to the disengagement position by the slope surface contacting the clutch restriction member.

16. The sheet feeding apparatus according to claim 12, wherein the clutch input portion is configured to move in an axial direction of the shaft.

17. The sheet feeding apparatus according to claim 16, wherein the clutch mechanism further comprises:

a clutch bearing fixed to the shaft and configured to integrally rotate with the shaft;

a key formed on the clutch bearing; and a key groove formed on the clutch input portion, with which the key engages so that the clutch input portion is configured to move in the axial direction of the shaft.

18. The sheet feeding apparatus according to claim 12, wherein the sheet feeding unit includes a roller configured to feed the sheet stacked on the stacking member, and wherein the clutch mechanism is provided on a transmitting path between the elevating unit and the sheet feeding roller.

19. The sheet feeding apparatus according to claim 12, wherein even when a number of sheets stacked on the stacking member is a few, the movement mechanism is configured to move the clutch input portion from the disengagement position to the engagement position after the elevating unit elevates the stacking member so that the sheet stacked on the stacking member contacts the sheet feeding unit.

* * * * *